US010138907B2

(12) United States Patent
Pinto et al.

(10) Patent No.: US 10,138,907 B2
(45) Date of Patent: Nov. 27, 2018

(54) ROTARY ENERGY RECOVERY DEVICE

(75) Inventors: Juan Miguel Pinto, Oakland, CA (US); Jeremy G. Martin, Oakland, CA (US); Richard L. Stover, Newton, MA (US)

(73) Assignee: Energy Recovery, Inc., San Leandro, CA (US)

( * ) Notice: Subject to any disclaimer, the term of this patent is extended or adjusted under 35 U.S.C. 154(b) by 696 days.

(21) Appl. No.: 13/518,850

(22) PCT Filed: Dec. 17, 2010

(86) PCT No.: PCT/US2010/061056

§ 371 (c)(1), (2), (4) Date: Feb. 1, 2013

(87) PCT Pub. No.: WO2011/079045

PCT Pub. Date: Jun. 30, 2011

(65) Prior Publication Data

US 2013/0121850 A1 May 16, 2013

Related U.S. Application Data

(60) Provisional application No. 61/289,955, filed on Dec. 23, 2009.

(51) Int. Cl.

| | |
|---|---|
| ***F04F 1/00*** | (2006.01) |
| ***F04F 13/00*** | (2009.01) |
| ***F04F 99/00*** | (2009.01) |

(52) U.S. Cl.

CPC ..... *F04F 13/00* (2013.01); *F04F 1/00* (2013.01); *F04F 99/00* (2013.01)

(58) Field of Classification Search

CPC ..... F04F 13/00; F04F 1/00; F04F 99/00

(Continued)

(56) References Cited

U.S. PATENT DOCUMENTS 3,019,962 A * 2/1962 Spalding ..... 417/64
3,101,168 A * 8/1963 Berchtold ..... 417/64

(Continued)

FOREIGN PATENT DOCUMENTS

| | | |
|---|---|---|
| CN | 1646846 | 7/2005 |
| CN | 101044325 | 9/2007 |
| WO | 2008042693 A1 | 4/2008 |

OTHER PUBLICATIONS

International Search Report issued in corresponding International Application No. PCT/US2010/061056 dated Aug. 16, 2011; 4 pages.

(Continued)

*Primary Examiner* — Essama Omgba
*Assistant Examiner* — Stephen Mick
(74) *Attorney, Agent, or Firm* — Fletcher Yoder, P.C.

(57) ABSTRACT

A rotary energy recovery device (11) wherein a multi-channel cylindrical rotor (15) revolves with its end faces (32) juxtaposed in sealing relationship with end surfaces (33) of a pair of flanking end covers (19, 21), and wherein inlet and outlet fluid passageways (27, 29) are provided in each end cover. Fluid may be directed into the rotor channels (16) and allowed to exit therefrom in an axial direction parallel to the axis of the rotor; however, rotor revolution is self-driven as a result of the interior design of the channels (16) which extend axially through the rotor and are shaped so that fluid flow therethrough creates a torque.

22 Claims, 7 Drawing Sheets

(58) Field of Classification Search
USPC ..... 417/64
See application file for complete search history.

(56) References Cited

U.S. PATENT DOCUMENTS 3,221,981 A * 12/1965 Dudley ..... F04F 13/00 417/64
3,291,380 A * 12/1966 Brown ..... F02B 33/42 417/64
3,458,116 A * 7/1969 Wunsch ..... F02B 33/42 415/119
3,556,680 A * 1/1971 Leutwyler ..... F04F 13/00 415/119
4,352,638 A * 10/1982 Vallance ..... F04F 13/00 416/DIG. 3
6,542,859 B1 4/2003 Burns et al.
7,201,557 B2 4/2007 Stover
7,306,437 B2 * 12/2007 Hauge ..... 417/64
8,022,567 B2 9/2011 Davis et al.
8,075,281 B2 12/2011 Martin et al.
2001/0033793 A1 10/2001 Lewis et al.
2003/0197368 A1 10/2003 Reifschneider et al.
2006/0032808 A1 2/2006 Hauge
2007/0212231 A1 * 9/2007 Bross et al. ..... 417/65
2009/0180903 A1 * 7/2009 Martin et al. ..... 417/405

OTHER PUBLICATIONS

Chinese First Office Action; dated Jan. 6, 2014, 10 Pages.
Korean Office Action; Korean Patent Application No. 2012-7018907; dated Jul. 26, 2016.
Korean Office Action; Korean Patent Application No. 2012-7018907; dated Jan. 3, 2017.
Korean Office Action for KR Application No. 10-2012-7018907 dated Mar. 3 2017; 19 Pages.
European Extended Search Report for EP Application No. 10 840 017.7-1004 dated Feb. 1, 2018; 8 pgs.

* cited by examiner

ROTARY ENERGY RECOVERY DEVICE

CROSS-REFERENCE TO RELATED APPLICATIONS

The present patent application enters the U.S. national stage under 35 U.S.C. § 371 of the Patent Cooperation Treaty (PCT) from international patent application number PCT/US2010/061056 filed Dec. 17, 2010, which claims the priority benefit of U.S. provisional application No. 61/289,955 filed on Dec. 23, 2009, each of which is incorporated by reference herein.

FIELD OF THE INVENTION

This invention relates to rotary energy recovery devices wherein a first fluid under a high pressure hydraulically communicates with a second lower pressure fluid within the axial channels of a rotor to transfer pressure between the fluids and produce a high pressure discharge stream of the second fluid. More particularly, the invention relates to rotary energy recovery units of this type wherein the fluids passing through the device effect the driving of the rotor so that no mechanical drive mechanism is required.

BACKGROUND OF THE INVENTION

Rotary energy recovery devices have been used for many decades. For example, patent applications filed in the 1960s showed constructions of such energy recovery devices wherein a multichannel rotor revolved within an exterior housing. In many of these early constructions, such as those shown in U.S. Pat. Nos. 3,431,747; 3,582,090 and 3,910,587, the rotor channels were of circular cross-section and balls were employed that would shift from near one end of the channel to near the other to reasonably effectively seal the channel to deter the mixing of the two fluids at an interface therebetween. These energy recovery devices were usually driven by a drive shaft extending from one end of the rotor through the use of a suitable electric motor or the like, using a belt or gear drive or the like. Later U.S. patents to Hauge, such as U.S. Pat. Nos. 4,887,942; 5,338,158 and 5,988,993 improved upon these earlier devices and avoided the need for use of balls or other sliding stoppers within the rotor channels. Moreover, in the '993 patent, for example, the liquids entering the device are used to create torque to drive the rotor, i.e. the liquid flow serves as the driving force for the energy recovery device. Such a drive concept is relied upon in the constructions shown in many later U.S. patents and published patent applications and is generally found in energy recovery units sold by the assignee of this application, Energy Recovery, Inc.

Very generally, the reliance upon the fluids, generally liquids flowing through the rotor to provide the rotary torque has been achieved through the construction of entrance and exit passageways in end covers through which the fluid enters into and exits from the rotors. These end covers can provide tangential flow vectors to accomplish this desired end, as described in the '993 patent and in U.S. Pat. Nos. 6,540,487, 7,221,557 and 7,306,437.

Illustrative of the foregoing is U.S. Pat. No. 6,540,487 wherein a rotor is illustrated similar to the cylindrical rotor 3 shown in FIG. 1 which contains twelve channels 5 that extend axially through the rotor from end face 6 to end face. The channels have openings 7, 9 at opposite ends and are all similar in shape. Each of the channels 5 has a pair of straight sidewalls of equal dimension that are aligned generally radially with respect to the axis or centerline of the rotor 3. End covers are employed that contain oblique ramps in the inlet and outlet passageways which cause the fluid to enter into and exit from the channels 5 with a directional vector in a manner such as to create torque upon the rotor 3 that causes it to revolve clockwise, as viewed in FIG. 1 and indicated by the reference arrow 4. As a result of such revolution in a clockwise direction, the sidewall of the channel opening that is leading is marked 7L and the sidewall that is trailing is marked 7T. This structure is essentially illustrative of rotary energy recovery devices upon which the present invention improves.

The patents more recent than the '993 patent provide evidence of various improvements in the art of rotary energy recovery devices, and work has continued to seek further improvements in the operation of devices of this character.

SUMMARY OF THE INVENTION

Whereas many of these rotary devices employ end covers that are used to angularly direct both high and low pressure incoming liquids, as well as the outgoing streams, obliquely with respect to the rotor channels to induce such rotary motion, it has now been found that rotary motion of such a multichannel rotor can be efficiently created by the interior shape of the channels themselves. It has been found that fluid streams can be simply delivered directly axially into the channels and similarly withdrawn from the rotor channels, thereby simplifying end cover construction; however, the rotor can still be caused to revolve by relying upon the shape of the rotor channels to create torque.

It has been found that channels in such a rotor can be provided with an appropriately radially aligned sidewall region within each channel that is shaped so as to induce the fluid flow in the channel to create an asymmetric low pressure region within the channel; the location of this region within the channel is so placed as to create torque on the rotor which causes the rotor to revolve. In one embodiment illustrated hereinafter, rotor channels, which have the shape of a segment of a generally annular region, have one wall that is fashioned in the longitudinally curved shape of an airfoil which is preferably arranged with its region of greatest thickness or camber at about the longitudinal center of the rotor. Complementary to such a curved sidewall is an opposed flat sidewall that is aligned essentially radially to the axis of the rotor. A low pressure region is created adjacent to the thick region of the curved sidewall when fluid flows axially through the rotor channels in either direction. As a result, net forces are applied essentially perpendicular to the flat surface of the sidewall opposite the curved wall because of the high pressure region there, which forces are tangential to the axis of the rotor, creating torque and driving revolution of the rotor.

In one particular aspect, the invention provides a cylindrical rotor having channels that extend end to end for use in a rotary energy recovery device for transferring high pressure from one fluid to a lower pressure fluid wherein the rotor will revolve about its axis in a cavity between means that sealingly interface with opposite ends of the rotor, and wherein a high pressure first fluid and a low pressure second fluid are supplied to opposite ends of the rotor resulting in the simultaneous fluid inlet flow and fluid discharge flow axially within said rotor channels, as a result of fluid flow, wherein the improvement comprises: at least a plurality of said channels having a cross section which varies longitudinally from end to end, which variance is the result of shaping an interior surface of a wall portion of each of said plurality of channels, which wall portion is located along what will be the trailing portion of said channel in the revolving rotor, so that a low pressure region is established as a result of axial fluid flow through said channel and as a consequence creates a torque that causes said rotor to revolve.

In another particular aspect, the invention provides an energy recovery device for transferring high pressure from one fluid to a lower pressure fluid, which device comprises a cylindrical rotor having axial channels that extend between opposite end faces, a housing in which said cylindrical rotor revolves, first and second end covers in said housing having interior faces arranged in sealing relationship with said rotor end faces, said end covers each having at least one inlet passageway and at least one discharge passageway extending therethrough, the angular alignment of said end cover passageways being such that, when a rotor channel is aligned with an inlet passageway in one end cover, it is simultaneously aligned with an outlet passageway in the other end cover, and at least two of said rotor channels having a cross section which varies from end to end as the result of one channel sidewall, that is oriented generally radially and that has a shape which establishes a low pressure region in such channel as a result of fluid flow axially therethrough, so that torque is created causing said rotor to revolve as a result of such flow through said channel.

In yet another particular aspect, the invention provides a rotary energy recovery device for transferring high pressure from one fluid to a lower pressure fluid wherein a substantially cylindrical rotor having channels extending axially therethrough revolves about its axis in a cavity between a pair of end covers that sealingly interface with opposite ends of the rotor, and wherein a high pressure first fluid and a low pressure second fluid are supplied to opposite ends of the rotor through passageways extending through said end covers resulting in the simultaneous filling with and discharge of fluids through the passageways in the opposite end covers as a result of fluid flow through said channels, the improvement which comprises at least a plurality of said channels in the rotor having a cross section which varies from end to end as the result of one sidewall region, that is oriented generally radially to the axis, having a shape which establishes a low pressure region along said sidewall region as a result of fluid flow through said channel and as a consequence creates a torque that causes said rotor to revolve.

DETAILED DESCRIPTION OF THE PREFERRED EMBODIMENTS

Figure 1:
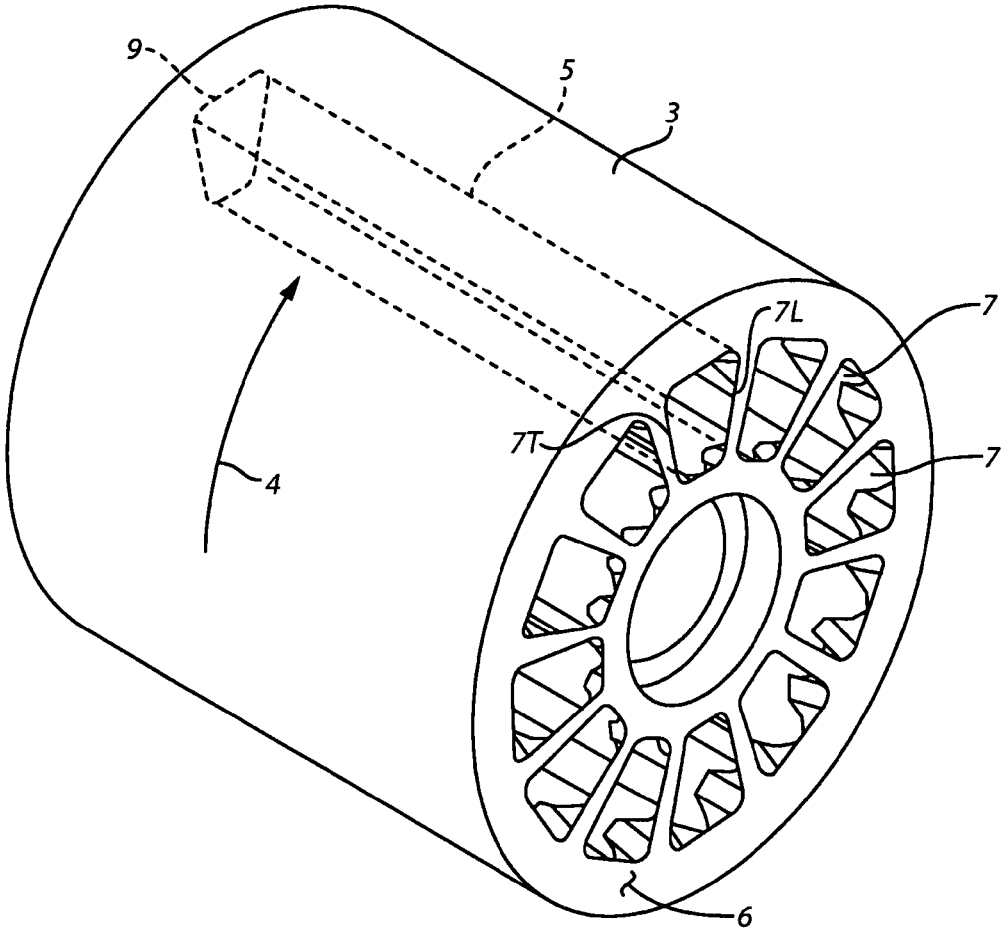
FIG. 1 Prior Art
FIG. 1 is a perspective view of a prior art rotor of a type used in rotary energy recovery devices of this general type.
Figure 2:
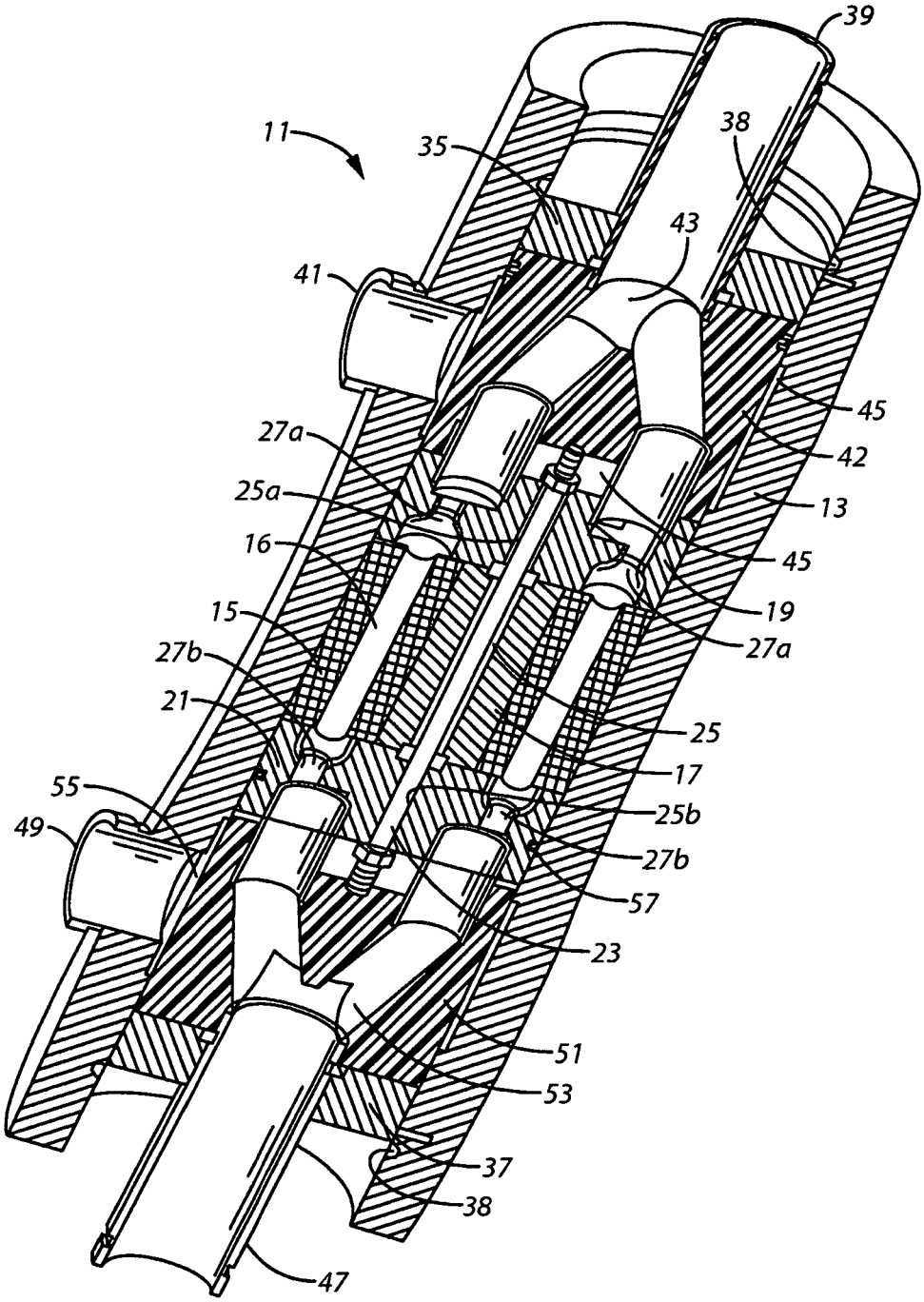
FIG. 2 is a perspective view shown in cross-section of a rotary energy recovery device of this general type that employs a multi-channel rotor.

Shown in FIG. 2 is a rotary energy recovery device 11 that includes an elongated, generally cylindrical housing or body 13 in which there is disposed a cylindrical rotor 15 (see FIG. 3) having a plurality of longitudinal channels 16 which extend end-to-end and open into the respective flat end faces 32 of the rotor. The channels 16 may have a variety of cross sectional shapes as described hereinafter. The rotor 15 is shown as revolving about a central hollow stator 17; however, such is optional and a surrounding sleeve may be employed as described in the '557 patent. Two end covers 19, 21, each having a plurality of passageways 27, 29, sandwich the rotor 15 therebetween; they function as means that sealingly interface with the rotor end faces 32. For convenience of explanation, the components may sometimes be referred to as upper and lower end covers in accordance with the orientation of the device in FIG. 2; however, such is merely used for convenience as it should be understood that the device may be operated in any orientation, vertical, horizontal or otherwise.

To permit these internal components to be handled as a unit, they are often united as a subassembly through the use of a central tension rod 23 which is located in an enlarged chamber 25 disposed axially of the rotor; the tension rod passes through axial passageways 25*a*, 25*b* in the upper and lower end covers. This threaded tension rod 23 is secured by washers and hex nuts or the like to create a subassembly of the four components wherein the two end covers 19, 21 are in abutting sealing contact with the ends of the stator 17. Preferably, short dowel pins (not shown) are seated in aligned holes in the end covers and the stator to assure the two end covers are maintained in precise alignment with each other via interconnection through the supporting hollow stator 17. A similar arrangement is used when a surrounding sleeve is used instead of an interior stator. The tolerances are such that, when the rotor 15 is revolving so as to transfer pressure between aqueous solutions or the like in the channels 16, there is a very thin liquid seal created between flat upper and lower end faces 32 of the rotor and the juxtaposed axially inward surfaces 33 of the upper and lower end covers 19, 21. Outlet and inlet passageways in the end covers terminate in openings in these flat interior surfaces 33 which may be of the same or different shapes. Although in FIG. 2 and in the accompanying Figures, the end faces 32 of the rotor and the end cover interior surfaces 33 are both flat as they presently are in commercial devices of this type, these surfaces need only meet in sealing relationship to each other; accordingly, they may be of any complementary shapes. For example, they may be frustoconical, spherical, or ellipsoidal.

Figure 8:
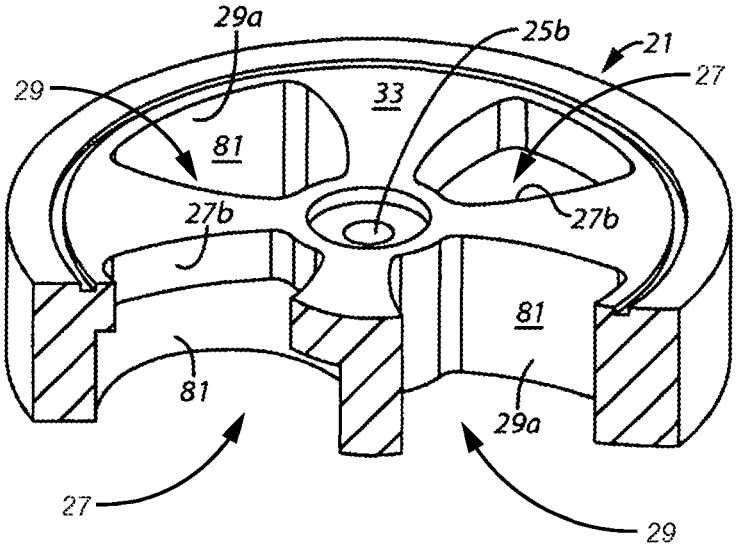
FIG. 8 is a perspective view of an end cover that might be used with the rotor, with a portion broken away.

Depicted in FIG. 2 are low pressure inlet passageways 27*a* and low pressure discharge passageways 27*b* in the respective end covers 19 and 21. The high pressure inlet passageways 29*a* are seen in FIG. 8 in the end cover 21; they are arranged generally equiangularly with the low pressure passageways 27. As seen in FIG. 2, when a channel 16 is aligned with an inlet passageway in one end cover, it is aligned with an outlet passageway in the other end cover.

The cylindrical housing 13 is closed by upper and lower closure plates 35, 37. Snap rings (not shown) or other suitable locking ring arrangements are received in grooves 38 in the housing to secure the closure plates 35, 37 in closed position. A low pressure liquid (e.g. seawater) inlet conduit 39 passes axially through the upper closure plate 35. A side outlet 41 in an upper region of the housing 13 is provided to discharge the seawater that has been increased in pressure within the device. A molded polymeric cylindrical body or interconnector 42 provides a branched conduit 43 to interconnect the seawater inlet 39 to the two low pressure (LP) inlet passageways 27*a* in the end cover 19. The molded body. 42 and the interior housing surface are shaped to also provide a plenum chamber 45 through which the high pressure (HP) outlet passageways (not shown) in the end cover 19 communicate with the side discharge conduit 41. The axial passageway 25*a* through the end cover 19 is enlarged in diameter to provide communication through the end cover 19 to this high pressure seawater plenum chamber 45.

A generally similar construction exists at the lower end where a conduit 47, which passes axially through the lower closure plate 37, serves to discharge a low pressure brine stream after it has transferred most of its pressure to the incoming seawater. High pressure brine enters through a side inlet 49 provided in a lower region of the housing, and a similar cylindrical molded polymeric interconnector 51 is located in the housing between the lower end cover 21 and the lower closure plate 37. The interconnector 51 is similarly formed to provide a branched conduit 53 through which the brine discharge conduit 47 is connected to the two LP outlet passageways 27*b* in the end cover 21. Its exterior is again shaped to create a high pressure plenum chamber 55 that provides communication between two brine HP inlet passageways and the high pressure brine side inlet 49. The lower end cover 21 through which the brine enters and exits may have a groove midway along its outer surface that accommodates an annular high pressure seal 57.

As an example of operation, low pressure seawater at about 30 psig may be supplied, as by pumping, into the straight conduit 39 at the upper end of the device, and high pressure brine from a reverse osmosis operation is supplied to the side inlet conduit 49 at, e.g., about 770 psig or higher. Because of the unique design of the channels 16 in the rotor, the passageways 27 and 29 through the end covers may be designed to supply fluid directly axially into and remove fluid directly axially from the channels 16; however, the fluid flow through the energy recovery device will still power the revolution of the rotor. Optionally, various of the passageways 27 and 29 through which the fluid will enter or discharge may be constructed so as to additionally add some driving torque as a result of non-axial directional entry and or exit should such be desired. Such an arrangement is described with respect to FIG. 9 hereinafter.

High pressure brine fills the lower plenum chamber 55 and flows therethrough to the two HP inlet passageways 29*a* in the lower end cover 21. As the rotor 15 revolves, this high pressure brine is supplied to the lower end of each channel 16 while the channel is in communication with the respective HP passageway opening; this simultaneously causes the same volume of liquid, e.g. seawater, to be discharged from the opposite end of the channel 16, which seawater has been raised to about the pressure of the incoming brine. Such discharge flow of the now pressurized second liquid (i.e. seawater) exits via an HP outlet passageway in the upper end cover 19 and then follows a path through the upper plenum 45 to the side outlet 41. When this rotating channel 16 next becomes aligned with an opening to a low pressure seawater inlet passageway 27*a* at the axially inward surface of the upper end cover 19, the channel will be simultaneously aligned with an LP brine outlet passageway 27*b* in the lower end cover 21, as seen in FIG. 2. Thus, as lower pressure seawater flows into the upper end of the channel 16, it causes discharge of the now depressurized brine through the branched conduit 53 and the straight brine outlet conduit 47 at the lower end of the energy recovery device 11.

Figure 3:
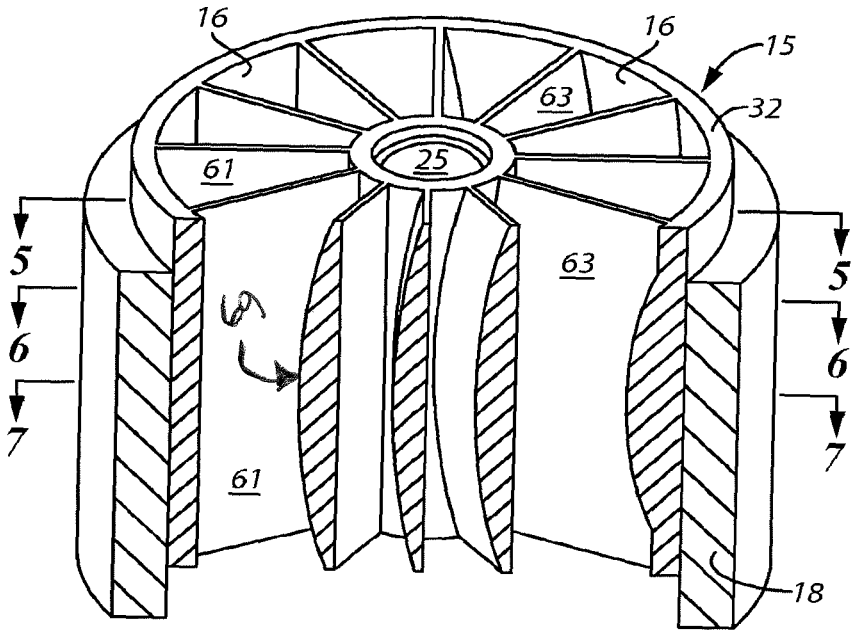
FIG. 3 is a perspective view, enlarged in size and with portions broken away, of a rotor embodying various features of the invention that might be used in the device of FIG. 2, shown with an alternative sleeve within which it revolves, instead an interior stator.
Figure 4:
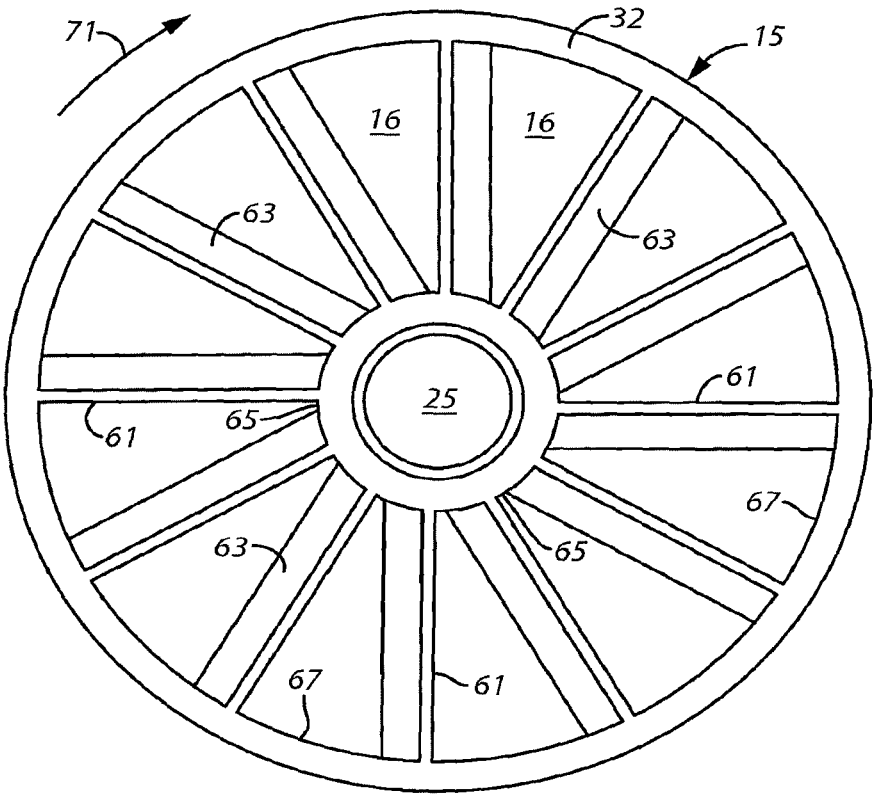
FIG. 4 is an end view of the multi-channel rotor of FIG. 3, enlarged in size.

As seen in more detail in FIG. 3, one embodiment of a rotor 15 is shown which is generally cylindrical in shape and has a central opening 25 through which the tension rod 23 would pass. A sleeve 18 of tubular shape and circular cross-section is fit around the exterior surface of the rotor 15 to provide an outer bearing surface as well known in this art. Alternatively, the central passageway 25 might be enlarged in diameter and an interior stator provided therewithin to provide an inner bearing surface. Twelve longitudinal channels 16 extend axially between the flat end surfaces 32 of the rotor, which channels at the opposite end faces are generally pie-shaped in cross-section and are spaced uniformly from one another. There are twelve channels 16 illustrated that are equiangularly spaced in an annular region about the central axis with each channel constituting an annular segment situated within a region of about 30° of the 360°.

Either the central stator 17 or the surrounding sleeve 18 is preferably mated with both of the end covers 19, 21 by short dowel pins (not shown) as known in this art, depending upon which construction is used. Such an arrangement provides a stable rotational platform for the rotor 15, particularly when the central tension rod 23 is installed to unite these components as a subassembly with the rotor 15 in place. Preferably, the design is such that hydrostatic bearing surfaces are created either between the laterally outer surface of the rotor 15 and the sleeve 18 or between the inner surface of the rotor and a stator 17. In the latter instance, two surface sections on the stator 17 may be spaced apart to provide a central recess that serves as a lubrication reservoir, as known in this art and described in published U.S. Application 2010/019152, the disclosure of which is incorporated herein by reference. A radial passageway may extend through the stator 17 from such a reservoir to an enlarged axial chamber in the stator and provide fluid communication therebetween. Such an axial chamber may be kept filled with high pressure seawater as a result of flow through the enlarged passageway 25*a* through the upper end cover 19 which is in communication with the upper plenum chamber 45 wherein the increased pressure seawater is present that is being discharged from the device 11.

The two end covers 19, 21 may be of generally similar construction. As seen in FIGS. 2 and 8, each cover is formed with two generally diametrically opposed low pressure passageways 27 and two high pressure passageways 29. The two low pressure passageways in each end cover are respectively interconnected to the two branched passageways 43, 53 (provided by the molded interconnectors 42, 51) which lead to the axially aligned conduits 39, 47 as seen in FIG. 2. All of the passageways 27 and 29 in the end covers 19, 21 are designed with smooth, generally straight walls that extend generally axially therethrough, as seen in FIG. 8. Each end cover has two inlet passageways and two discharge passageways, and as a result of their shaping, there is essentially straight flow in an essentially axial direction into and out of each rotating channel 16 through the respective openings in the flat, axially inward end surfaces 33 of the end covers 19, 21.

Figure 9:
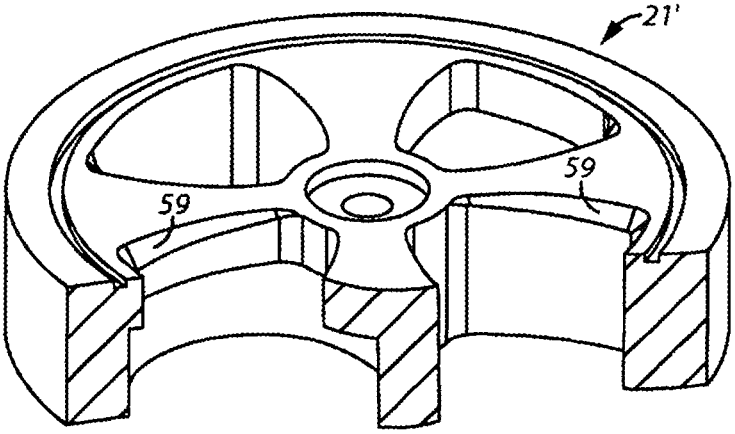
FIG. 9 is a view similar to FIG. 8 of an alternative embodiment of an end cover.

If desired, any of these passageways, e.g. the high pressure passageways, or both sets of passageways, may be shaped with interior walls have oblique ramps 59 formed therein to direct the high pressure liquid obliquely into or out of the channels 16 in the rotor; FIG. 9 shows such an alternative embodiment of an end cover 21'. However, there are manufacturing advantages in providing such straight-walled passageways wherein all the walls are rectilinear and parallel to the axis of the rotor, and such a construction is permitted as a result of the channel design.

Respective pairs of HP passageways in the end covers are respectively connected via the plenum chambers 45, 55 to the side conduits 41, 49. As mentioned hereinbefore, the plenum chambers are created by the shaping of the exterior surfaces of the molded polymeric interconnectors 42, 51 to create a central chamber which is joined with shallow recesses in the interior wall of the housing 13 at the interfacial regions between the end covers and the end closure plates to provide communication to each side conduit 41, 49 in the housing wall.

As a result, when the device is used in conjunction with a seawater desalination operation, the high pressure brine enters through the side inlet 49, fills the plenum chamber 55 and flows through the high pressure inlet passageways 29*a* in the lower end cover 21 causing the now pressurized seawater to exit from the opposite upper end of each channel 16. Liquid flow through the uniquely shaped rotor channels 16 creates effective force vectors which create torque to drive the rotor 15. Thus, despite the fact that all the end cover passageways may be essentially smooth-walled passageways that simply supply a flow of liquid axially into or remove discharge of liquid axially from the channels 16, the unique shape of the channels creates torque in the form of forces tangential to the rotor, which causes it to revolve.

The rotor 15, depicted in FIGS. 2, 3, 4, 5, 6 and 7, has the shape of a right circular cylinder with a hollow axial core; a stator 17 and/or a tensioning rod may be located therewithin about which the rotor will revolve. Alternatively, as well known in this art, the center portion of the rotor 15 can be solid or can be left generally open while the rotor revolves within a surrounding thin sleeve 18 which provides an exterior bearing surface. The novelty of the rotor 15 lies in the shaping of the rotor channels 16. It can be seen from the drawings that the twelve channels 16 that extend longitudinally or axially through the rotor 15, from end face to end face, are all similar in construction and have a cross section that is referred to as generally segmental. Although the number of such rotor channels 16 may vary depending upon the diameter of the rotor and the specific design purpose of the device, such rotors will often have between about 10 and 20 such channels. In this respect, each of the channels 16 has two straight sidewalls 61,63 i.e. they are essentially rectilinear in a radial direction; these two sidewalls are preferably angled to each other at between about 20 and about 40 degrees, with the illustrated channels 16 having sidewalls aligned at about a 30 degree angle. Each of the rotor channels occupies portions of a region of about 30 degrees of the circumference of the circular rotor; however, as can be seen from FIG. 5, it is the leading sidewall 61 (in the direction of revolution) that is oriented precisely radially of the axis of the rotor. The two sidewalls are connected via a short arcuate inner wall 65 and by a shallow arcuate outer wall 67 that has a radius of curvature such that it is essentially concentric with the right circular cylinder of the rotor. The leading sidewalls 61 are essentially planar, and the shallow arcuate outer end walls 67 are also essentially rectilinear in an axial direction.

The trailing sidewalls 63 in the illustrated embodiment shown in FIGS. 3-7 are formed with an airfoil shape so as to create a low pressure region along what will be the trailing sidewalls of the twelve channels of the rotor. The camber of the trailing sidewall 63 in the embodiment of FIGS. 3-7 is axially symmetric, as best seen in FIG. 3, with its camber being such that the thickest region 69 of the protruding sidewall lies at the longitudinal center of each channel (see FIG. 7). The interior arcuate end wall 65 follows the curvature of the trailing sidewall 63 in the axial direction and is blended smoothly with it. As a result of this unique interior construction of the channels 16, the pressure of the liquid or other fluid being pumped or otherwise caused to travel through the channels, during its flow axially through the channels, is diminished adjacent the camber surface of the trailing wall 63 of each channel where a low pressure region is created. As a result, a net force is created in a direction tangentially to the axis of the rotor away from the cambered sidewalls which results in clockwise revolution of the rotor as depicted by the arrow 71 in the end view seen in FIG. 4. Thus, the interior design of the rotor channels 16 is such that the flow of fluid through the channels in either direction results in the creation of a torque that causes the rotor 15 to revolve. It should be understood that, if for a particular application, the design of these channels 16 with the airfoil sidewall 63 should cause revolution at too high a speed, the rotor could be constructed so that two or four or six or more of the channels might be constructed with simple straight-walled design so they would not contribute to the torque that powers the revolution of the rotor. At least two channels 16 would be constructed with the cambered sidewalls 63; preferably, at least half of them would have this construction. More preferably, a majority or all of them would have such construction.

Figure 5:
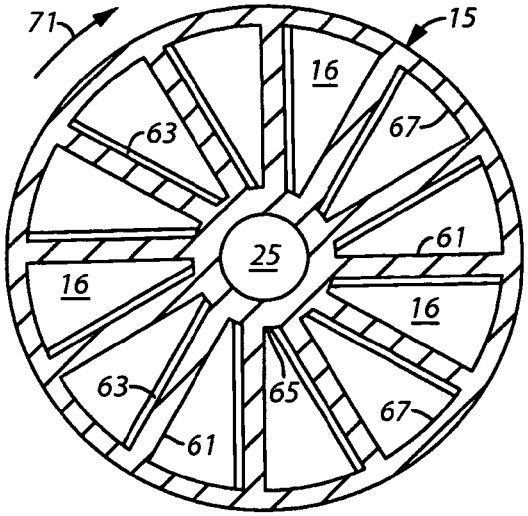
FIGS. 5, 6, and 7 are cross-sectional views taken, respectively, along the lines 5-5, 6-6, and 7-7 of FIG. 3.
Figure 6:
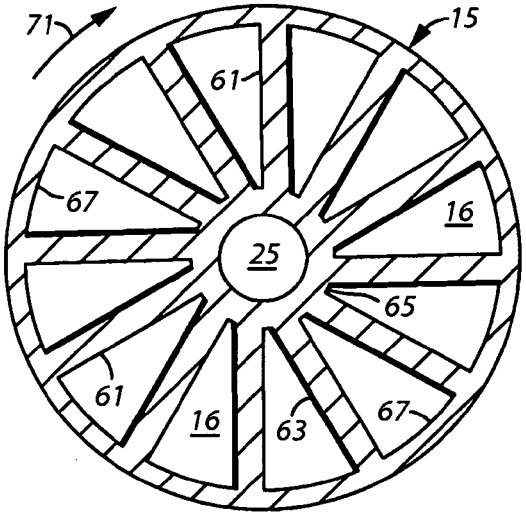
Figure 7:
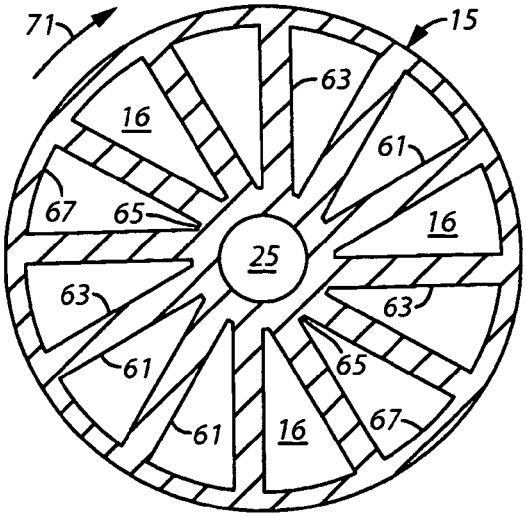
Figure 10:
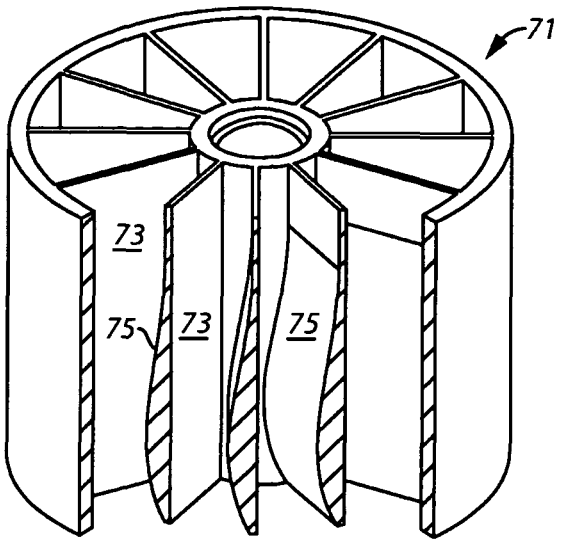
FIGS. 10 and 11 are perspective views of two alternative rotor embodiments.

The illustrated channels 16 have trailing sidewalls 63 that are symmetrical, with a similar camber on both axial halves of the sidewall. FIG. 7 is a cross sectional view taken at the axial midpoint which shows the web between adjacent channels 16 at its greatest thickness at this location, where the wall may be thought of as protruding to the greatest extent into the region of the channel. FIGS. 5 and 6 are taken sequentially closer to the end face 32 and show web growing progressively thinner. The result of such symmetry is that the forces created are axially neutral. In some instances, it may be important to balance the pressures present at both surfaces of end covers to prevent long-term warpage of such covers from potentially occurring. It is found that, by alternatively shaping the trailing sidewalls of such a rotor so as to have a non-symmetric camber, the resulting pressure distribution can create a net axial force on the rotor itself in addition to the torque that causes it to revolve. FIG. 10 illustrates such a rotor 71 in perspective; it is broken away to show three of the webs in cross section; the illustrated channels are formed with one flat sidewall 73 and one sidewall 75 having such a non-symmetrical camber. In such a rotor 71, axial force would be directed to vector the rotor downward, which would be against the end cover where the higher pressure exists, e.g. the end cover through which the incoming HP brine stream flows, in order to balance the pressure in this manner.

As previously mentioned, FIG. 8 shows a representative end cover 21 that has four passageways, i.e. two HP inlet passageways 29*a* and two LP outlet passageways 27*b* extending through it to four openings in the flat inward surface 33 of the end cover 21, which surface seals against the flat end face 32 of the rotor 15. Because of the novel design of the rotor channels 16, the manufacturing of appropriate end covers can be simplified, merely providing passageway chambers having straight rectilinear walls 81 devoid of any machined oblique ramps; such passageways would deliver the fluid directly axially into the passing channel 16 and would receive outflowing streams in an axial direction. By in an axial direction is meant a direction essentially parallel to the axis of the rotor. Alternatively, if desired for a particular operation, an end cover 21 might be employed wherein two or more of the passageways are provided with an oblique ramp 59 as shown in FIG. 9, so as to effect additional torque to increase the speed of revolution of the rotor.

The rotor might have any desired number of channels, preferably spaced equiangularly about the circumference of the rotor, depending on its actual size. Whereas many rotors might have 10 to 12 relatively large channels such as illustrated, rotors of a diameter over a foot or so might well have a greater number of such channels. Likewise, a rotor such as that illustrated in published International Application No. WO2009/046429 having inner and outer circular rows of channels, could be constructed so that only one of the rows, for example the outermost row, would be made using the unique channel shaping while the other rows simply employed channels of axially or longitudinally rectilinear shape.

Although the rotor has been described as having channels of the preferred segmental shape, the benefits of the invention can be obtained using channels of a variety of different cross-sectional shapes, for example, even round, oval or ellipsoidal shape. Generally, so long as a longitudinal sidewall region of such channel that is so located and oriented radially to the axis of the rotor and shaped to created a low pressure region such that it will become a trailing wall of the channel when the rotor revolves, torque will be created as a result of differential forces being exerted against the opposed longitudinal region of the channel's sidewall, which will become the leading sidewall. For example, rotors might be made using individual tubes, such as shown in published International Application WO 2008/002819, and such tubes of circular cross section could be carefully bent or swaged so that one longitudinally extending sidewall region of a tube would be smoothly and uniformly deformed inward to create an airfoil camber resembling the wall shape seen in FIG. 3. As a result, the differential high pressure forces exerted against the opposed, arcuate region of the channel would cause rotation, with this opposed arcuate region moving as the leading wall portion of each channel.

The use of the combination of a rotor with such airfoil-shaped sidewalls in its channels and end covers with straight, smooth inlet and outlet passageways gives rise to various manufacturing and operational advantages. There will be lower pressure drop through such energy recovery devices that do not include flow-directing oblique ramps, and this should give rise to improved efficiency. It is also felt that such axial inflow and outflow to and from the channels results in a quieter operation and less mixing between fluids, particularly liquids, within the channels because a more even flow profile will result. Devices using such rotors are also expected to achieve a more constant ratio of flow to rotor RPM. Moreover, the elimination of ramps should give rise to the use of larger openings in the faces of the end covers which will allow for higher flow rates for a rotor of a given diameter.

The creation of such airfoil-shaped channels in a solid ceramic cylinder to the like can be accomplished in a straightforward manner through vertical milling operations which would mill half of the length of each channel from each end. Alternatively, the rotor could be made in two halves (or in even more parts) that would then be secured together to create an integral body, or the rotor could be constructed from a multitude of individual tubes as mentioned hereinbefore.

Figure 11:
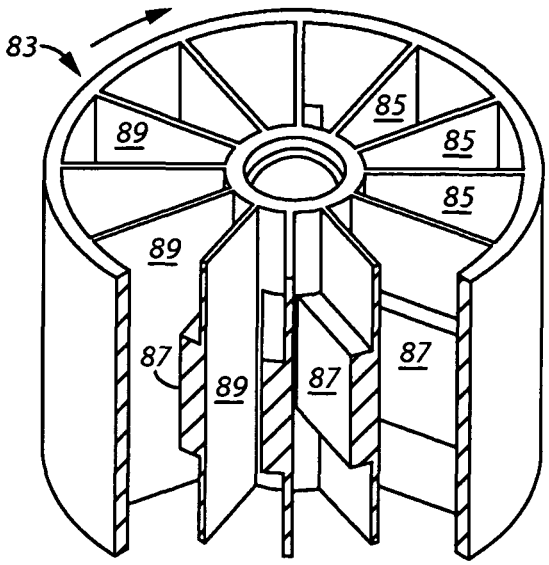

Although the invention has been illustrated to show embodiments which constitute the best mode presently known to the inventors for carrying out their invention, it should be understood that various changes and modification as would be obvious to one of ordinary skill in this art may be made without departing from the scope of the invention, which is set forth in the claims that are appended hereto. For example, it is known that other disruptions along a surface along which fluid is flowing can also be employed to create uniform low pressure regions therealong in addition to the commonly known airfoil camber. For example, a rotor 83 might be constructed wherein the trailing sidewall 85 of such segmental channels could be shaped as shown in FIG. 11; protrusions 87 would give rise to low pressure regions that would result in a differential torque-inducing force away from the trailing sidewall of the same channel. The flat leading sidewalls 89 would preferably be aligned generally radially to the axis of the rotor. As described before, the resultant rotor would revolve clockwise, as depicted by the arrow.

Figure 12:
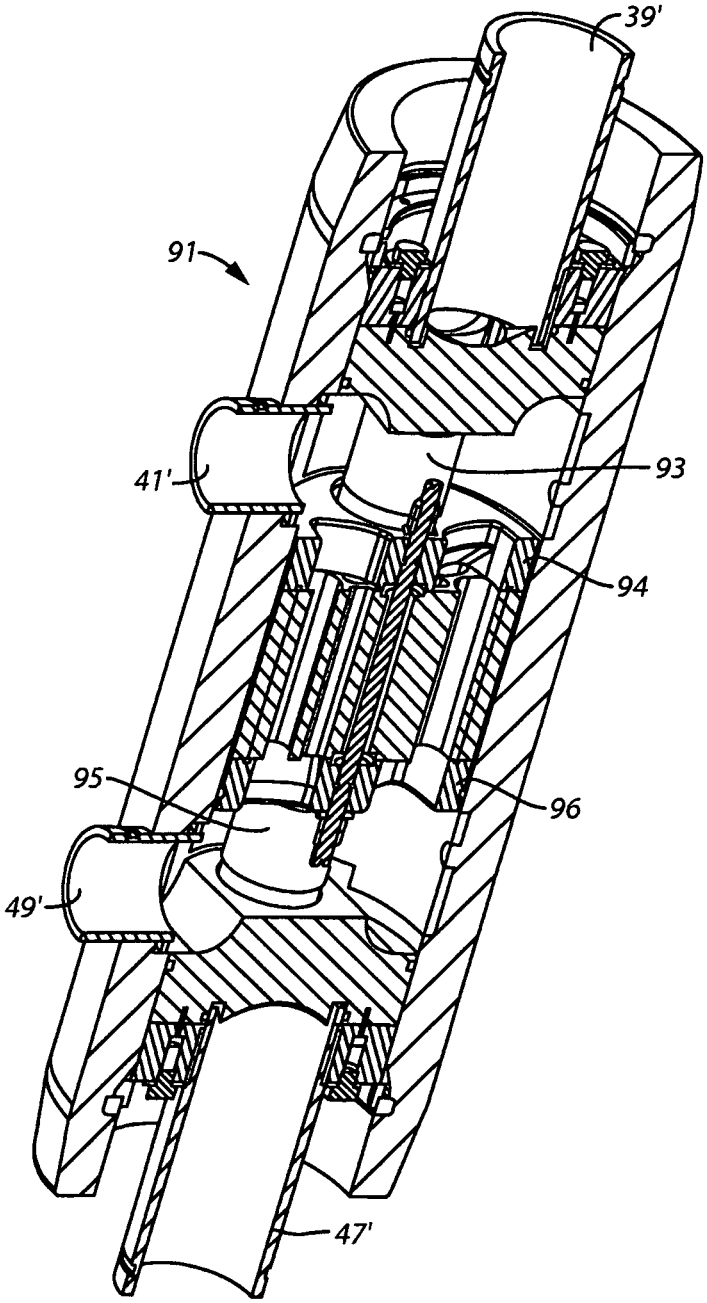
FIG. 12 is a view similar to FIG. 2 of an alternative embodiment of such a device with a modified end cover arrangement.

Heretofore, one function of the pair of end covers which traditionally flank such a multi-channeled rotor and seal against the end faces thereof has heretofore often been to provide such machined inlet and outlet passageways that include oblique ramps in order to create directional forces so that the pumped fluid drives the rotor; however, with the present invention, end covers of such ramped shape would no longer be required for rotors having this unique channel shaping. As a result, it is contemplated that rotary energy recovery devices 91 might be constructed that might essentially eliminate the end covers 19 and 21 which are shown in FIG. 2 or at least employ end covers of reduced sophistication. One such embodiment is shown in FIG. 12 wherein a pair of tubular extensions 93, that are interconnected with the low pressure inlet conduit 39', extend to the rotor and terminate in end surfaces that lie in sealing juxtaposition with the flat end faces 32 of the rotor 31; these tubular extensions 93 pass through a generally hollow spacer plate 94 and serve as smooth-walled, axially parallel inlet passageways preferably for the low pressure seawater. A similar pair of tubular extensions 95 are provided that interconnect with the low pressure outlet conduit 47' and pass through openings in a similar spacer plate 96 to similarly sealingly interface with the flat surface 32 at the other end of the rotor. The essentially open chambers in the respective spacer plates 94, 96, respectively surrounding each of those pairs of extension tubes 93, 95, provide plenum chambers that are respectively in fluid communication with the high pressure brine side inlet 49' or with the HP seawater side outlet 41' for supplying and removing the high pressure fluids.

Particular features of the invention are emphasized in the claims which follow.

The invention claimed is:

1. A system comprising:

a rotor disposed in a rotary energy recovery device and comprising:

a plurality of blades circumferentially spaced apart and each blade of the plurality of blades having a respective longitudinal length extending from a first longitudinal end to a second longitudinal end and a respective radial width extending from the first longitudinal end to the second longitudinal end, wherein each blade of the plurality of blades comprises a first wall having a first face and a second face that is substantially opposite the first face in a circumferential direction relative to the respective longitudinal length, wherein the first face has a curved surface extending the respective longitudinal length from the first longitudinal end to the second longitudinal end and the second face has a substantially flat surface extending the respective longitudinal length and the respective radial width from the first longitudinal end to the second longitudinal end;

a plurality of channels that extend from a first end of the rotor to a second end of the rotor wherein at least one channel of the plurality of channels has a first radial cross-sectional area and a second radial cross-sectional area having a total area different from a total area of the first radial cross-sectional area relative to a longitudinal axis of the at least one channel of the plurality of channels, and wherein the at least one channel of the plurality of channels forms a low pressure region that creates torque to rotate the rotor using axial fluid flow through the rotor, wherein the at least one channel is disposed between the first face of a first blade of the plurality of blades and the second face of a second blade of the plurality of blades that is adjacent the first blade;

a housing in which the rotor rotates; and first and second end covers in the housing comprising interior faces arranged in a sealing relationship with first and second rotor end faces.

2. The system of claim 1, wherein each of the plurality of channels has a cross section of segmental shape with a first straight sidewall, a second straight sidewall, an outer end wall, and an inner end wall, and wherein the first straight sidewall comprises an airfoil shape and the second straight sidewall is substantially flat.

3. The system of claim 2, wherein the first and second straight sidewalls of the plurality of channels are each aligned substantially radially about a central axis of the rotor.

4. The system of claim 3, wherein the first and second sidewalls of each of the plurality of channels are aligned at an angle to each other of between about 20 degrees and about 40 degrees and wherein the outer and inner end walls are curved.

5. The system of claim 2, wherein the first straight sidewall has a camber which is symmetrical with respect to both ends of the rotor and establishes the low pressure region in an axially central region of the channel.

6. The system of claim 2, wherein the first straight sidewall has a camber which is non-symmetrical.

7. The system of claim 1, wherein the cylindrical rotor contains some axial channels which have only longitudinally rectilinear sidewalls.

8. The system of claim 1, wherein the cylindrical rotor contains between about 10 to 20 channels arranged substantially equiangularly about the axis of the rotor.

9. The system of claim 1, wherein the cylindrical rotor has flat end faces.

10. The system of claim 1, wherein the first and second end covers comprise at least one inlet passageway and at least one outlet passageway extending therethrough, the angular alignment of the at least one inlet and outlet passageways being so that when the at least one channel is aligned with the at least one inlet passageway in the first cover or the second cover the rotor is simultaneously aligned with the at least one outlet passageway in the opposing first end cover or the second end.

11. The system of claim 10, wherein the first and second end covers have flat interior faces and the at least one inlet and outlet passageways are shaped so that fluid enters and exits the plurality of channels in an axial direction.

12. The system of claim 1, comprising a sidewall region that is oriented generally radially to the longitudinal axis of the at least one channel of the plurality of channels, wherein the sidewall region is configured to form the low pressure region.

13. A system comprising:

a housing;

a rotor within the housing, the rotor comprising:

a hub;

an outer wall extending circumferentially about the hub;

a plurality of blades, wherein each blade of the plurality of blades has a respective longitudinal length extending from a first longitudinal end to a second longitudinal end and a respective radial width extending from the first longitudinal end to the second longitudinal end, wherein the plurality of blades are circumferentially spaced apart and radially extending between the hub and the outer wall, wherein each blade of the plurality of blades comprises a first sidewall having a first face having a curved surface extending the respective longitudinal length from the first longitudinal end to the second longitudinal end and a second face that is substantially opposite the first face in a circumferential direction relative to the respective longitudinal length, wherein the second face has a substantially flat surface extending the respective longitudinal length and the respective radial width from the first longitudinal end to the second longitudinal end such that a wall thickness of each blade of the plurality of blades varies along the respective longitudinal length from the first longitudinal end to the second longitudinal end;

axial channels disposed between adjacent blades of the plurality of blades and extending between a first end of the rotor and a second end of the rotor, wherein at least one axial channel of the axial channels comprises a first radial cross-sectional area and a second radial cross-sectional area having a total area different from a total area of the first radial cross-sectional area relative to a longitudinal axis of the at least one axial channel, and wherein the first radial cross-sectional area is configured to form a low pressure region that rotates the rotor as a fluid flows through the rotor; and a first end cover and a second end cover in the housing, wherein the first and second end covers comprise at least one inlet passageway and at least one outlet passageway.

14. The system of claim 13, wherein the plurality of blades comprise a first end wall, a second end wall, wherein the first sidewall has an airfoil shape.

15. The system of claim 14, wherein the airfoil shape is symmetrical and wherein the first end wall and the second end wall are curved.

16. The system of claim 13, comprising a sidewall region that is oriented generally radially to the longitudinal axis of the at least one axial channel, wherein the sidewall region is configured to form the low pressure region.

17. A rotary energy recovery device comprising:

a pressure exchanger configured to transfer pressure from a first liquid to a second liquid having a lower pressure relative to the first liquid, wherein the pressure exchanger comprises:

a plurality of channels disposed within a rotor and each channel of the plurality of channels having a respective longitudinal length extending from a first longitudinal end to a second longitudinal end and a respective radial width extending from the first longitudinal end to the second longitudinal end, wherein the plurality of channels is configured to receive a flow of the first and second liquid, wherein at least one channel of the plurality of channels comprises a first wall having a first face having a curved surface extending the respective longitudinal length from the first longitudinal end to the second longitudinal end and a second wall spaced apart from and substantially opposite the first wall having a second end face having a substantially flat surface extending the respective longitudinal length and the respective radial width from the first longitudinal end to the second longitudinal end such that the at least one channel of the plurality of channels comprises a first radial cross-sectional area and a second radial cross sectional area having a total area that is different from a total area of the first radial cross-sectional area relative to a longitudinal axis of the at least one channel of the plurality of channels and a sidewall region that is oriented generally radially to the longitudinal axis, wherein the sidewall region is configured to form a low pressure region that creates torque for the rotary energy recovery device as liquid flows through the at least one channel of the plurality of channels.

18. The energy recovery device of claim 17, wherein each of the plurality of channels comprises a first sidewall, a second sidewall, an inner end wall, and an outer end wall, wherein the first sidewall comprises an airfoil shape and the second sidewall is substantially flat.

19. The energy recovery device of claim 18, wherein the second sidewall is substantially flat from the first end of the rotor to the second end of the rotor.

20. The energy recovery device of claim 19, wherein the first sidewall and the second sidewall form an angle of between about 20 degrees and about 40 degrees with respect to an axis of the rotor, and wherein the outer and inner end walls are curved.

21. The energy recovery device of claim 17, wherein the airfoil shape of the first sidewall is symmetrical with respect to the first and second ends of the rotor, and wherein the airfoil shape of the first sidewall is configured to form the low pressure region in an axially central region of the at least one channel of the plurality of channels.

22. The energy recovery device of claim 17, comprising first and second end covers with at least one passageway that fluidly communicates with the plurality of channels.

* * * * *